US006352416B1

(12) United States Patent
Ota et al.

(10) Patent No.: US 6,352,416 B1
(45) Date of Patent: Mar. 5, 2002

(54) DEVICE AND METHOD FOR CONTROLLING DISPLACEMENT OF VARIABLE DISPLACEMENT COMPRESSOR

(75) Inventors: Masaki Ota; Kazushige Murao; Tetsuhiko Fukanuma; Shigeyuki Hidaka; Satoshi Koumura; Masaru Hamasaki, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/523,534

(22) Filed: Mar. 10, 2000

(30) Foreign Application Priority Data

Mar. 15, 1999 (JP) ..... 11-069037
Sep. 10, 1999 (JP) ..... 11-257987

(51) Int. Cl.[7] ..... F04B 1/26
(52) U.S. Cl. ..... 417/222.2
(58) Field of Search ..... 417/222.2, 265, 417/270, 312; 92/73; 91/493

(56) References Cited

U.S. PATENT DOCUMENTS

| | | | | |
|---|---|---|---|---|
| 5,332,365 | A | 7/1994 | Taguchi | |
| 5,836,748 | A | 11/1998 | Kawaguchi et al. | |
| 6,024,008 | A | 2/2000 | Kawaguchi et al. | |
| 6,203,284 | B1 * | 3/2001 | Kawaguchi et al. | 417/222.2 |

FOREIGN PATENT DOCUMENTS

| | | | |
|---|---|---|---|
| DE | 39 08 610 A | 9/1990 | |
| EP | 0 498 552 A1 | 8/1992 | F04B/1/28 |
| EP | 0 707 182 A2 | 4/1996 | |
| EP | 0 845 593 A1 | 6/1998 | F04B/1/00 |
| EP | 0 846 865 A1 | 6/1998 | |
| JP | 3-23385 | 1/1991 | |
| JP | 6-229635 | 8/1994 | |
| JP | 9-268973 | 10/1997 | |
| JP | 11-201054 | 7/1999 | |

* cited by examiner

*Primary Examiner*—Teresa Walberg
*Assistant Examiner*—Vinod D Patel
(74) *Attorney, Agent, or Firm*—Morgan & Finnegan, LLP

(57) ABSTRACT

A variable displacement compressor compresses gas supplied from an evaporator of an external refrigerant circuit and discharges the compressed gas to the refrigerant circuit. A check valve is located between the compressor suction chamber and the evaporator. The check valve prevents gas flow from the suction chamber to the evaporator. When the compressor is stopped, a displacement control valve increases the pressure in a crank chamber of the compressor to move a swash plate to a minimum inclination position. The pressure in the suction chamber is increased by gas supplied from the crank chamber. Closing the check valve accelerates a pressure increase in the suction chamber. When the pressure in the suction chamber is increased, the control valve limits a further pressure increase in the crank chamber. As a result, the force that decreases the inclination of the swash plate is limited.

20 Claims, 9 Drawing Sheets

DEVICE AND METHOD FOR CONTROLLING DISPLACEMENT OF VARIABLE DISPLACEMENT COMPRESSOR

BACKGROUND OF THE INVENTION

The present invention relates to a variable displacement compressor used in vehicle air conditioners. Specifically, the present invention pertains to a device and a method for controlling the displacement of a variable displacement compressor.

FIG. 12 shows a prior art variable displacement compressor. The compressor includes a housing 101. A crank chamber 102 is defined in the housing 101. A drive shaft 103 is supported in the housing 101. A lip seal 104 is located between the housing 101 and the drive shaft 103 to prevent gas leakage along the surface of the drive shaft 103.

The drive shaft 103 is connected to a vehicle engine Eg, which serves as an external power source, through an electromagnetic friction clutch 105. The friction clutch 105 includes a pulley 106, an armature 107 and an electromagnetic coil 108. The pulley 106 is coupled to the engine Eg, and the armature 107 is coupled to the drive shaft 103. When the clutch 105 engages, that is, when the coil 108 is excited, the armature 107 is attracted to and is pressed against the pulley 106. As a result, the clutch 105 transmits the driving force of the engine Eg to the drive shaft 103.

When the clutch 105 disengages, that is, when the coil 108 is de-excited, the armature 107 is separated from the pulley 106. In this state, the driving force of the engine Eg is not transmitted to the drive shaft 103.

A rotor 109 is secured to the drive shaft 103 in the crank chamber 102. A thrust bearing 122 is located between the rotor 109 and the inner wall of the housing 101. A swash plate 110 is coupled to the rotor 109 by a hinge mechanism 111. The hinge mechanism 111 permits the swash plate 110 to rotate integrally with the drive shaft 103 and to incline with respect to the axis L of the drive shaft 103. A limit ring 112 is fitted about the drive shaft 103. When the swash plate 110 abuts against the limit ring 112 as illustrated by broken lines in FIG. 12, the swash plate 110 is at the minimum inclination position.

Cylinder bores 113, suction chamber 114 and a discharge chamber 115 are defined in the housing 101. A piston 116 is reciprocally housed in each cylinder bore 113. The pistons 116 are coupled to the swash plate 110. The housing 101 includes a valve plate 117. The valve plate 117 separates the cylinder bores 113 from the suction chamber 114 and the discharge chamber 115.

Rotation of the drive shaft 103 is converted into reciprocation of each piston 116 by the rotor 109, the hinge mechanism 111 and the swash plate 110. Reciprocation of each piston 116 draws refrigerant gas from the suction chamber 114 to the corresponding cylinder bore 113 via a suction port 117*a* and a suction valve flap 117*b*, which are formed in the valve plate 117. Refrigerant gas in each cylinder bore 113 is compressed to reach a predetermined pressure and is discharged to the discharge chamber 115 via a discharge port 117*c* and a discharge valve flap 117*d*, which are formed in the valve plate 117.

A spring 118 urges the drive shaft 103 forward (to the left as viewed in FIG. 12) along the axis L through a thrust bearing 123. The spring 118 prevents axial chattering of the drive shaft 103.

The crank chamber 102 is connected to the suction chamber 114 by a bleeding passage 119. The discharge chamber 115 is connected to the crank chamber 102 by a supply passage 120. The opening of the supply passage 120 is regulated by an electromagnetic displacement control valve 121.

The control valve 121 adjusts the opening of the supply passage 120 to regulate the amount of pressurized refrigerant gas drawn into the crank chamber 102 from the discharge chamber 115. The pressure in the crank chamber 102 is changed, accordingly. Changes in the crank chamber pressure alter the gas pressure moment acting on the pistons 116 through the swash plate 110, which changes the inclination of the swash plate 110. Accordingly, the stroke of each piston 116 is changed and the compressor displacement is varied. The gas pressure moment depends on the crank chamber pressure and the pressure in the cylinder bore 113, which act on the pistons 116.

When the clutch 105 disengages or when the engine Eg is stopped, the control valve 121 fully opens the supply passage 120, which increases the pressure in the crank chamber 102. Accordingly, the gas pressure moment decreases the inclination of the swash plate 110. The compressor stops operating with the swash plate 110 at the minimum inclination position. When the compressor is started again, the displacement of the compressor is minimum, which requires minimum torque. The shock caused by starting the compressor is thus reduced.

When there is a relatively great cooling demand on a refrigeration circuit that includes the compressor, for example, when the temperature in a passenger compartment of a vehicle is much higher than a target temperature set in advance, the control valve 121 closes the supply passage 120 and maximizes the compressor displacement.

When the clutch 105 disengages or when the engine Eg is stopped, the compressor is stopped. If the compressor is stopped when operating at the maximum displacement, the control valve 121 quickly and fully opens the supply passage 120, which was fully closed. Accordingly, highly pressurized refrigerant gas in the discharge chamber 115 is quickly supplied to the crank chamber 102. Refrigerant gas in the crank chamber 102 constantly flows to the suction chamber 114 through the bleeding passage 119. However, since the amount of refrigerant gas that flows to the suction chamber 114 through the bleeding passage 119 is limited, the pressure in the crank chamber 102 is quickly and excessively increased by as the supply passage 120 is quickly and fully opened. Also, when the compressor is stopped, the pressure in each cylinder bore 113 approaches the pressure in the suction chamber 114, which is relatively low. As a result, the gas pressure moment decreasing the swash plate inclination becomes excessive.

Accordingly, the swash plate 110 is moved from the maximum inclination position to the minimum inclination position and strongly presses the drive shaft 103 rearward (to the right as viewed in FIG. 12) through the limit ring 112. The swash plate 110 also strongly pulls the drive shaft 103 rearward through the hinge mechanism 111 and the rotor 109. The drive shaft 103 is thus moved rearward along its axis L against the force of the spring 118.

When the drive shaft 103 moves rearward, the axial position of the drive shaft 103 relative to the lip seal 104, which is retained in the housing 101, changes. Normally, a predetermined annular area of the drive shaft 103 contacts the lip seal 104. Foreign particles and sludge adhere to areas of the drive shaft 103 that are axially adjacent to the predetermined annular area. Therefore, if the axial position of the drive shaft 103 relative to the lip seal 104 changes, sludge enters between the lip seal 104 and the drive shaft 103. This lowers the effectiveness of the lip seal 104 and results in gas leakage from the crank chamber 102.

Particularly, when the drive shaft 103 moves rearward due to disengagement of the clutch 105, the armature 107, which is fixed to the drive shaft 103, moves toward the pulley 106. The clearance between the pulley 106 and the armature 107 is as small as 0.5 mm when the clutch 105 disengages. Rearward movement of the drive shaft 103 eliminates the clearance between the pulley 106 and the armature 107, which may cause the armature 107 to contact the rotating pulley 106. This produces noise and vibration. Also, even if the clutch 105 disengages, the driving force of the engine Eg may be transmitted to the drive shaft 103.

When the drive shaft 103 moves rearward, the average position of the pistons 116, which are coupled to the drive shaft 103 by the swash plate 110, is moved rearward. This causes the top dead center of each piston 116 to approach the valve plate 117. As a result, the pistons 116 may collide with the valve plate 117 when at their top dead center positions.

To prevent the drive shaft 103 from moving rearward, the force of the spring 118 may be increased. However, a greater spring force increases the load acting on the thrust bearings 122, 123 and increases the power loss of the compressor.

SUMMARY OF THE INVENTION

Accordingly, it is an objective of the present invention to provide displacement control device and method for variable displacement compressors that prevent a moment decreasing the inclination of the swash plate from being excessively increased.

To achieve the foregoing and other objectives and in accordance with the purpose of the present invention, a compressor for compressing gas supplied from an evaporator of an external refrigerant circuit and for discharging the compressed gas to the external refrigerant circuit is provided. The compressor includes a housing, a cylinder bore defined in the housing, a crank chamber defined in the housing and a suction chamber defined in the housing. The suction chamber is connected to the outlet of the evaporator. Gas is constantly released from the crank chamber to the suction chamber. The compressor further includes a piston, a drive shaft supported by the housing, a drive plate, a control valve and a check valve. The piston is accommodated in the cylinder bore and compresses gas drawn into the cylinder bore from the suction chamber and discharges the compressed gas from the cylinder bore. The drive plate is coupled to the piston to convert rotation of the drive shaft into reciprocation of the piston. The drive plate is supported by the drive shaft to incline relative to the drive shaft and is moved between a maximum inclination position and a minimum inclination position in response to a tilt moment acting on the drive plate. The tilt moment has components including a moment based on the pressure in the crank chamber and a moment based on the pressure in the cylinder bore. The inclination of the drive plate defines the stroke of the piston and the displacement of the compressor. The control valve controls the pressure in the crank chamber to change the inclination of the drive plate and is actuated based on an external command. The check valve is located between the suction chamber and the evaporator and is closed based on the pressure difference between the suction chamber and the outlet of the evaporator to prevent gas from flowing from the suction chamber to the evaporator.

The present invention may also be embodied in a displacement control valve for adjusting the pressure in a crank chamber of a compressor to change the displacement of the compressor. The compressor includes a suction pressure zone, the pressure of which is a suction pressure, a discharge pressure zone, the pressure of which is a discharge pressure, and a supply passage connecting the crank chamber to the discharge pressure zone. The control valve includes a valve body, a pressure sensing member and an electromagnetic actuator. The valve body adjusts the size of an opening in the supply passage. The pressure sensing member moves the valve body in response to the suction pressure to maintain the suction pressure at a predetermined target value. The electromagnetic actuator applies a force to the valve body. The force corresponds to the level of a current supplied to the actuator. The level of the current determines a target value of the suction pressure. The actuator increases the target value as the level of the current decreases and sets the target value to a maximum value when no current is supplied to the actuator.

The present invention may further be embodied in a method for controlling the displacement of a variable displacement compressor. The compressor includes a drive plate that is moved between a maximum inclination position and a minimum inclination position in accordance with the pressure in a crank chamber. The inclination of the drive plate defining the displacement of the compressor. The method includes: controlling the pressure in the crank chamber to change the inclination of the drive plate when the compressor is operating; increasing the pressure in the crank chamber to move the drive plate to the minimum inclination position when the compressor is stopped; and restricting an increase of the pressure in the crank chamber when a predetermined time has elapsed after the compressor is stopped.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 7(*b*) shows a graph representing displacement of the drive shaft of a compressor of a comparison example and a graph representing the changes of the crank chamber pressure, the suction pressure and the cylinder bore pressure after the comparison example compressor is stopped;

FIG. 10(*b*) is a graph showing the value of current supplied to a control valve of a comparison example and a target suction pressure;

DETAILED DESCRIPTION OF THE PREFERRED EMBODIMENTS

A variable displacement compressor according to a first embodiment of the present invention will now be described with reference to FIGS. 1 to 7(*b*). The compressor is used in a vehicle air conditioner.

Figure 1:
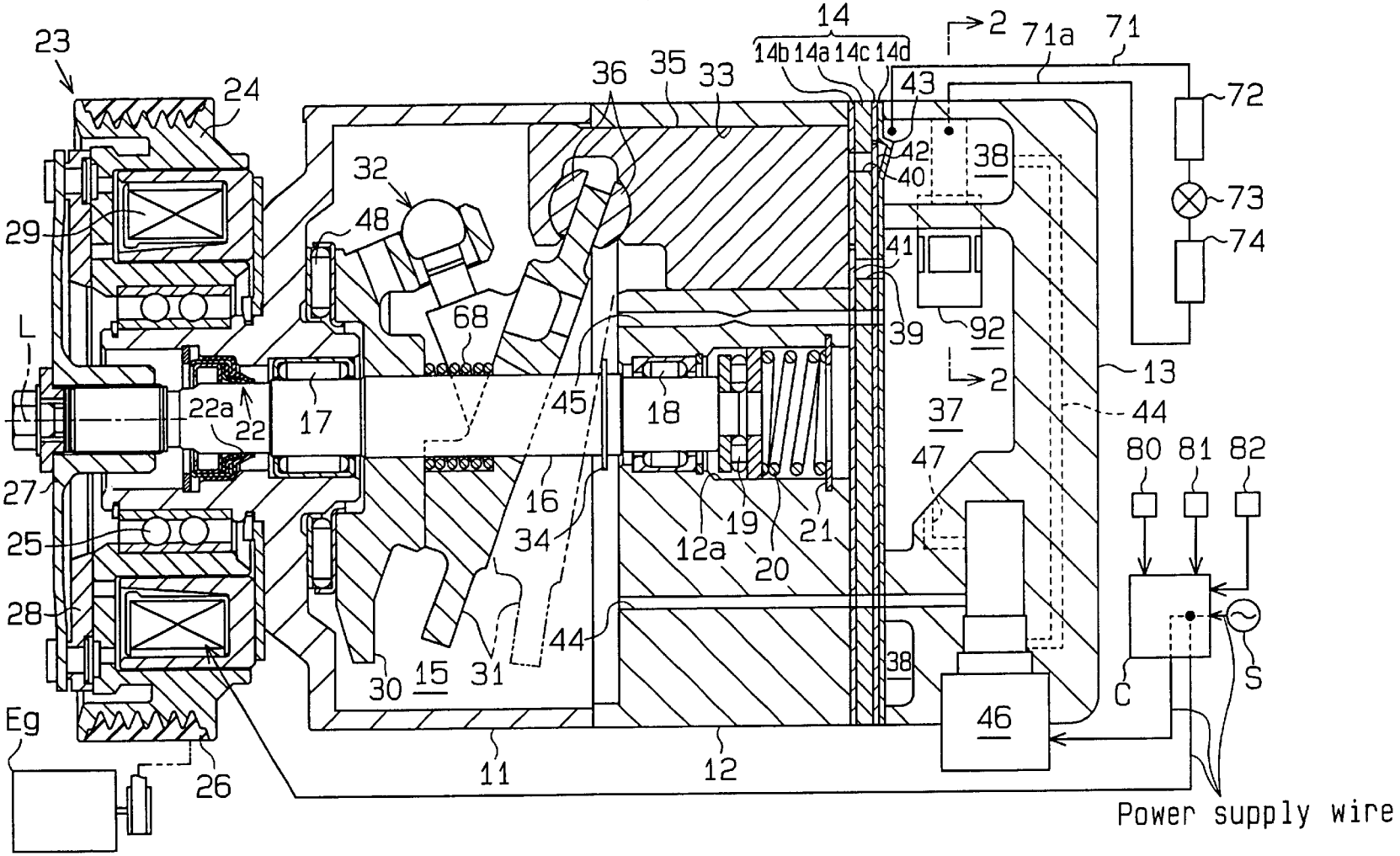
FIG. 1 is a cross-sectional view illustrating a variable displacement compressor according to a first embodiment of the present invention.

As shown in FIG. 1, a front housing 11 is secured to the front end face of a center housing, which is a cylinder block 12 in this embodiment. A rear housing 13 is secured to the rear end face of the cylinder block 12, and a valve plate assembly 14 is located between the rear housing 13 and the rear end face. The front housing 11, the cylinder block 12, the rear housing 13 form the compressor housing. The left in FIG. 1 is defined as the front side of the compressor and the right in FIG. 1 is defined as the rear side of the compressor.

The valve plate assembly 14 includes a main plate 14*a*, a first sub-plate 14*b*, a second sub-plate 14*c*, and a retainer plate 14*d*. The main plate 14*a* is located between the first sub-plate 14*b* and the second sub-plate 14*c*. The retainer plate 14*d* is located between the second sub-plate 14*c* and the rear housing member 13.

A control pressure chamber, which is a crank chamber 15 in this embodiment, is defined between the front housing 11 and the cylinder block 12. A drive shaft 16 extends through the crank chamber 15 and is rotatably supported by the front housing 11 and the cylinder block 12.

The drive shaft 16 is supported by the front housing 11 via a radial bearing 17. A central bore 12*a* is formed substantially in the center of the cylinder block 12. The rear end of the drive shaft 16 is located in the central bore 12*a* and is supported by the cylinder block 12 via a radial bearing 18. A spring seat 21 is fitted to the wall of the central bore 12*a*. A thrust bearing 19 and a support spring 20 are located in the central bore 12*a* between the rear end of the drive shaft 16 and the spring seat 21. The support spring 20 urges the drive shaft 16 forward along the axis L of the drive shaft 16 through the thrust bearing 19. The thrust bearing 19 prevents rotation of the drive shaft 16 from being transmitted to the support spring 20.

The front end of the drive shaft 16 projects from the front end of the front housing 11. A shaft sealing assembly, which is a lip seal 22 in this embodiment, is located between the drive shaft 16 and the front housing 11 to prevent leakage of refrigerant gas along the surface of the drive shaft 16. The lip seal 22 includes a lip ring 22*a*, which is pressed against the surface of the drive shaft 16.

An electromagnetic friction clutch 23 is located between an external power source, which is a vehicle engine Eg in this embodiment, and the drive shaft 16. The clutch 23 selectively transmits power from the engine Eg to the drive shaft 16. The clutch 23 includes a pulley 24, a hub 27, an armature 28 and an electromagnetic coil 29. The pulley 24 is supported by the front end of the front housing 11 with an angular bearing 25. A belt 26 is engaged with the pulley 24 to transmit power from the engine Eg to the pulley 24. The hub 27, which has elasticity, is fixed to the front end of the drive shaft 16 and supports the armature 28. The armature 28 faces the pulley 24. The electromagnetic coil 29 is supported by the front wall of the front housing 11 to face the armature 28.

Figure 6:
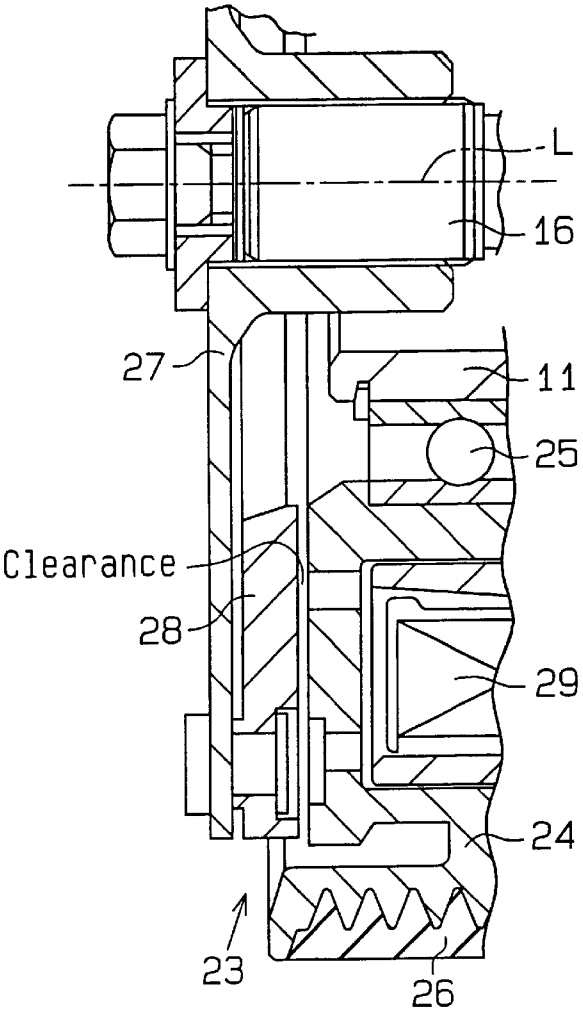
FIG. 6 is an enlarged partial cross-sectional view illustrating the clutch of FIG. 1 when it disengages.

When the coil 29 is excited while the engine Eg is running, an electromagnetic attraction force is generated between the armature 28 and the pulley 24. Accordingly, as shown in FIG. 1, the armature 28 contacts the pulley 24 against the force of the hub 27, which engages the clutch 23. When the clutch 23 is engaged, power from the engine Eg is transmitted to the drive shaft 16 via the belt 26 and the clutch 23. When the coil 29 is de-excited in this state, the armature 28 is separated from the pulley 24 by the force of the hub 27 as shown in FIG. 6, which disengages the clutch 23. When the clutch 23 is disengaged, transmission of power from the engine Eg to the drive shaft 16 is disconnected.

As shown in FIG. 1, a rotor 30 is fixed to the drive shaft 16 in the crank chamber 15. A thrust bearing 48 is located between the rotor 30 and the inner wall of the front housing 11. A drive plate, which is a swash plate 31 in this embodiment, is supported on the drive shaft 16 to slide axially and to incline with respect to the axis L of the drive shaft 16. A hinge mechanism 32 is located between the rotor 30 and the swash plate 31. The swash plate 31 is coupled to the rotor 30 via the hinge mechanism 32. The hinge mechanism 32 rotates the swash plate 31 integrally with the rotor 30. The hinge mechanism 32 also guides the swash plate 31 to slide along and incline with respect to the drive shaft 16.

A coil spring 68 is fitted about the drive shaft 16 and is located between the rotor 30 and the swash plate 31. The coil spring 68 urges the swash plate 31 in a direction disinclining the swash plate 31.

A limit ring 34 is attached to the drive shaft 16 between the swash plate 31 and the cylinder block 12. As shown by the broken line in FIG. 1, the inclination of the swash plate 31 is minimized when the swash plate 31 abuts against the limit ring 34. On the other hand, as shown by solid lines in FIG. 1, the inclination of the swash plate 31 is maximized when the swash plate 31 abuts against the rotor 30.

Figure 5:
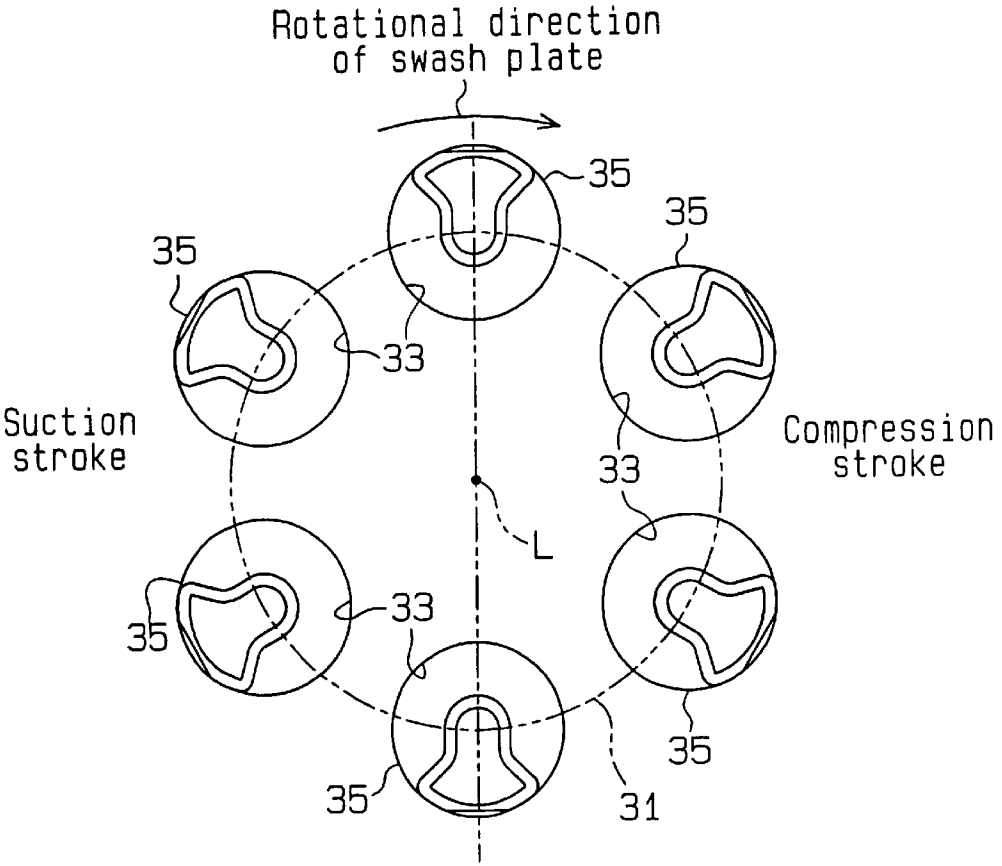
FIG. 5 is a diagrammatic view showing the arrangement of the pistons in the compressor of FIG. 1.

As shown in FIGS. 1 and 5, cylinder bores 33, the number of which is six in this embodiment, are formed in the cylinder block 12. The cylinder bores 33 are arranged at equal angular intervals about the axis L of the drive shaft 16. A single headed piston 35 is accommodated in each cylinder bore 33. Each piston 35 is coupled to the swash plate 31 by a pair of shoes 36. The swash plate 31 converts rotation of the drive shaft 16 into reciprocation of the pistons 35.

Figure 2:
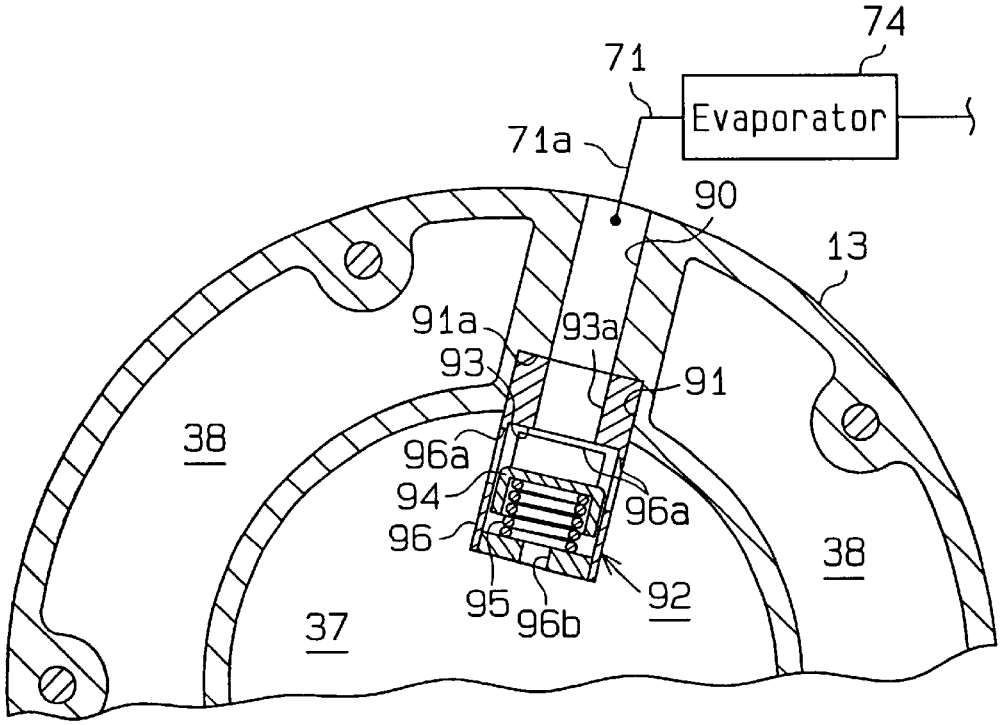
FIG. 2 is a cross-sectional view taken along line 2—2 of FIG. 1.

As shown in FIGS. 1 and 2, a suction chamber 37, the pressure of which is a suction pressure Ps, is defined in the substantial center of the rear housing 13. A discharge chamber 38, the pressure of which is a discharge pressure Pd, is formed in the rear housing 13 and surrounds the suction chamber 37. The valve plate assembly 14 separates the cylinder bores 33 from the suction chamber 37 and from the discharge chamber 38. The main plate 14*a* of the valve plate assembly 14 has suction ports 39 and discharge ports 40, which correspond to each cylinder bore 33. The first sub-plate 14*b* has the suction valve flaps 41, each of which corresponds to one of the suction ports 39. The second sub-plate 14*c* has the discharge valve flaps 42, each of which corresponds to one of the discharge ports 40. The retainer plate 14*d* has retainers 43, which correspond to the discharge valve flaps 42. Each retainer 43 determines the maximum opening size of the corresponding discharge valve flap 42.

When each piston 35 moves from the top dead center position to the bottom dead center position, refrigerant gas in the suction chamber 37 flows into the corresponding cylinder bore 33 via the corresponding suction port 39 and suction valve flap 41. When each piston 35 moves from the bottom dead center position to the top dead center position, refrigerant gas in the corresponding cylinder bore 33 is compressed to a predetermined pressure and is discharged to the discharge chamber 38 via the corresponding discharge port 40 and discharge valve flap 42.

A supply passage 44 connects the discharge chamber 38 to the crank chamber 15. A bleeding passage 45 connects the crank chamber 15 to the suction chamber 37. A displacement control valve 46 is located in the supply passage 44. The control valve 46 adjusts the flow rate of refrigerant gas from the discharge chamber 38 to the crank chamber 15 by varying the opening size of the supply passage 44. The pressure in the crank chamber 15 is varied in accordance with the relationship between the flow rate of refrigerant gas 7.from the discharge chamber 38 to the crank chamber 15 and that from the crank chamber 15 to the suction chamber 37 through the bleeding passage 45. Accordingly, the difference between the pressure in the crank chamber 15 and the pressure in the cylinder bores 33 is varied, which changes the inclination of the swash plate 31, or the stroke of each piston 35. This alters the stroke of each piston 35 and the compressor displacement.

The inclination of the swash plate 31 is determined according to various moments acting on the swash plate 31. The moments include a rotational moment, which is based on the centrifugal force of the rotating swash plate 31, a spring force moment, which is based on the force of the spring 68, an inertia moment, which is based on inertia of each piston 35, and a gas pressure moment, which is based on the net force applied to each piston 35. The sum of these moments will be hereafter referred to as the tilt moment. The rotational moment acts on the swash plate 31, for example, to decrease the inclination. The inertia moment acts on the swash plate 31, for example, to increase the inclination. The gas pressure moment depends on the pressure in the cylinder bores 33 (bore pressure Pb), which acts on the pistons 35, and the pressure in the crank chamber 15 (crank chamber pressure Pc), which also acts on the pistons 35. The gas pressure moment acts on the swash plate 31 to decrease or to increase the swash plate inclination.

In the embodiment of FIGS. 1 to 7(*b*), the gas pressure moment changes in accordance with the crank chamber pressure Pc, which is controlled by the displacement control valve 46. If the crank chamber pressure Pc is increased, the gas pressure moment influences the tilt moment such that the swash plate inclination is decreased. If the crank chamber pressure Pc is lowered, the change of the gas pressure moment is reversed. Therefore, tilt moment acting on the swash plate 31 is adjusted by controlling the crank chamber pressure Pc with the control valve 46. Accordingly, the swash plate 31 is moved to a desired inclination position between the minimum inclination position and the maximum inclination position. When the compressor is stopped and the pressures in the chambers of the compressor become substantially equalized, the swash plate 31 is retained at the minimum inclination position by the force of the spring 68 (or the spring force moment).

Figure 4:
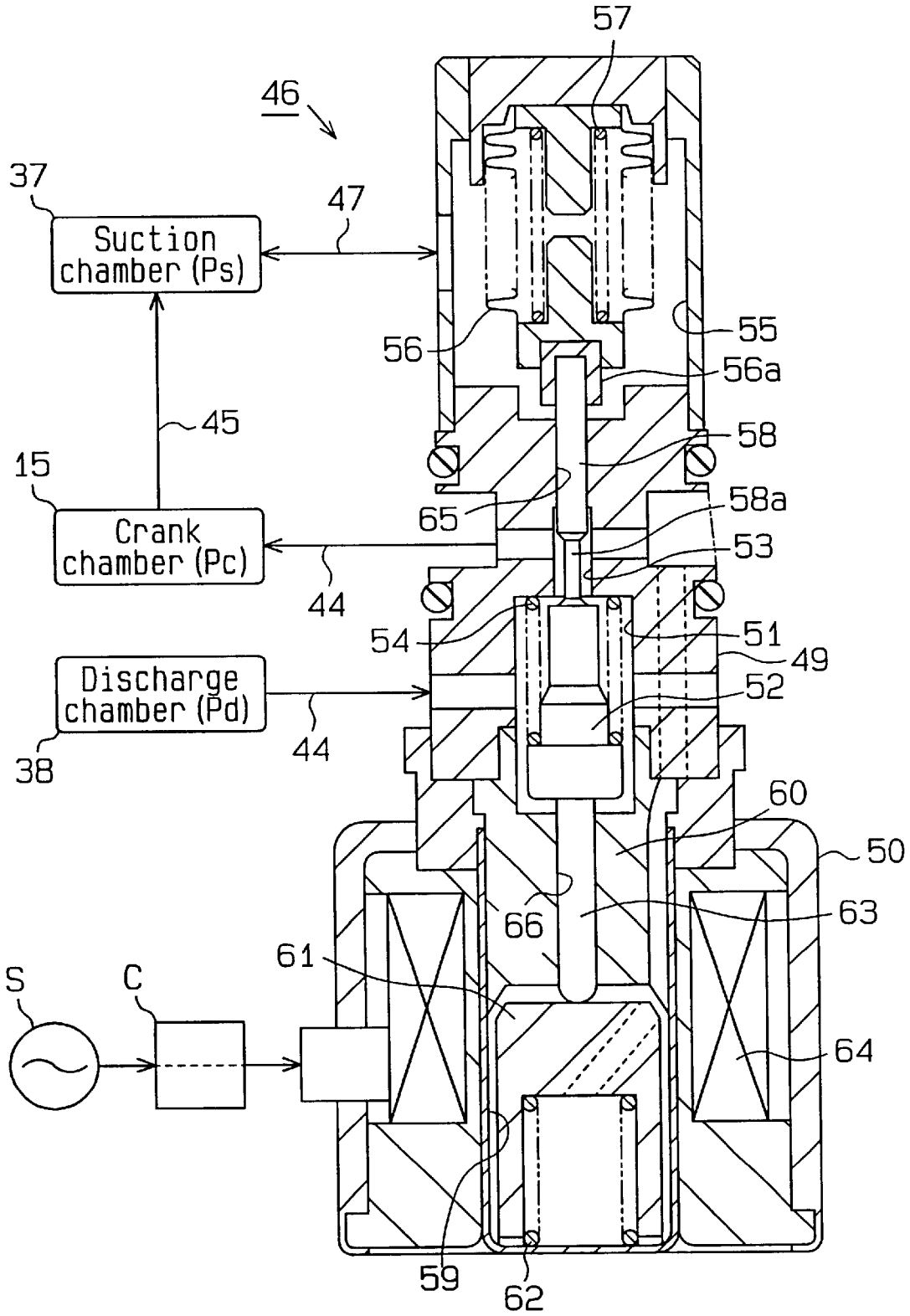
FIG. 4 is an enlarged cross-sectional view illustrating the displacement control valve used in the compressor of FIG. 1.

The control valve 46 will now be described. As shown in FIG. 4, the control valve 46 includes a valve housing 49 and the solenoid 50. The housing 49 and the solenoid 50 are secured to each other and define a valve chamber 51. The valve chamber 51 is defined in the substantial center of the control valve 46. A valve body 52 is accommodated in the valve chamber 51. An opening of a valve hole 53 in the valve chamber 51 faces the valve body 52. The valve chamber 51 and the valve hole 53 form part of the supply passage 44. The valve chamber 51 is connected to the discharge chamber 38 through the upstream portion of the supply passage 44. The valve hole 53 is connected to the crank chamber 15 through the downstream portion of the supply passage 44. An opening spring 54 is located in the valve chamber 51 between the wall and the valve body 52 to urge the valve body 52 in a direction opening the valve hole 53.

A pressure sensing mechanism is located above the valve chamber 51. The pressure sensing mechanism moves the valve body 52 in accordance with the suction pressure Ps. A pressure sensing chamber 55 is located above the valve chamber 51. The pressure sensing chamber 55 is connected to the suction chamber 37 by a pressure introduction passage 47 formed in the rear housing 13. A pressure sensing member, which is a bellows 56 in this embodiment, is accommodated in the pressure sensing chamber 55. The upper end of the bellows 56 is fixed to the upper wall of the pressure sensing chamber 55. A setting spring 57 is located in the bellows 56. The spring 57 determines the initial length of the bellows 56.

A guide hole 65 extends through the valve housing 49 to connect the pressure sensing chamber 55 to the valve chamber 51 though the valve hole 53. A pressure sensing rod 58 extends from the valve body 52 toward the bellows 56 to operably couple the bellows 56 with the valve body 52. The bellows 56 is formed integrally with the valve body 52. The distal end of the rod 58 is fixed to the coupler cylinder 56*a* located at the distal end of the bellows 56. A small diameter portion 58*a* is formed in the rod 58 at a portion located in the valve hole 53. The annular clearance between the small diameter portion 58*a* and the wall of the valve hole 53 forms a conduit for gas.

The solenoid 50, or an electromagnetic actuator, will now be described. A plunger chamber 59 is defined below the valve chamber 51. A fixed core 60 is located between the plunger chamber 59 and the valve chamber 51. A plunger, which is a movable core 61, is accommodated in the plunger chamber 59. A follower spring 62 is accommodated in the plunger chamber 59 to urge the movable core 61 toward the valve body 52. The force of the follower spring 62 is weaker than the force of the opening spring 54.

The guide hole 66 extends through the fixed core 60 to connect the valve chamber 51 to the plunger chamber 59. A solenoid rod 63 is formed integrally with the valve body 52 and extends through the guide hole 66. The force of the opening spring 54 and the force of the follower spring 62 cause the distal end of the solenoid rod 63 to contact the movable core 61. The valve body 52 and the movable core 61 are coupled to each other through the solenoid rod 63. An electromagnetic coil 64 is located about the fixed core 60 and the movable core 61.

The suction chamber 37 is connected to the discharge chamber 38 by an external refrigerant circuit 71. The external refrigerant circuit 71 includes a condenser 72, an expansion valve 73 and an evaporator 74. The external refrigerant circuit 71 and the compressor define a cooling circuit of the vehicle air conditioner.

An air conditioner switch 80, a compartment temperature sensor 81 and a temperature adjuster 82 are connected to a controller C. The compartment temperature sensor 81 detects the temperature in the passenger compartment. The temperature adjuster 82 is used to set a target compartment temperature. Power supply wires extend from a power source S, which is a vehicle battery, to the coil 29 of the clutch 23 and to the coil 64 of the control valve 46 via the controller C.

The controller C includes a computer. The controller C controls a current from the power source S to the coils 29, 64 based on various conditions including, for example, the ON/OFF state of the starting switch 80, the temperature detected by the compartment temperature sensor 81 and the target temperature set by the temperature adjuster 82.

Generally, when the engine Eg is stopped (when the key switch of the vehicle turned off), current is stopped to almost all the electrical devices. When the engine Eg is stopped, the power supply wire between the coils 29, 64 and the power source S is disconnected upstream of the controller C. Accordingly, the current to the coils 29, 64 from the power source S is stopped.

The operation of the compressor having the control valve 46 will now be described. If the starting switch 80 is turned on and the temperature detected by the temperature sensor 81 is higher than a target temperature set by the temperature adjuster 82 while the engine Eg is running, the controller C supplies current from the power source S to the coil 29. The clutch 23 engages accordingly, which starts the compressor.

The controller C determines the level of current supplied to the coil 64 of the control valve 46 based on signals from the compartment temperature sensor 81 and the temperature adjuster 82. The controller C supplies a current having the determined level from the power source S to the coil 64. Accordingly, an electromagnetic attraction force is generated between the fixed core 60 and the movable core 61. The magnitude of the attraction force corresponds to the value of the received current. The attraction force urges the valve body 52 in a direction decreasing the opening size of the valve hole 53. The bellows 56 of the control valve 46 expands and contracts in accordance with the pressure (suction pressure Ps) applied to the pressure sensing chamber 55 from the suction chamber 37. The bellows 56 applies a force to the valve body 52, and the magnitude of the force corresponds to the suction pressure Ps in the pressure sensing chamber 55.

Thus, the opening size of the valve hole 53 is determined based on the force applied to the valve body 52 by the bellows 56, the attraction force between the fixed core 60 and the movable core 61 and the force of the springs 54, 62.

The controller C increases the value of the current supplied to the coil 64 when there is a greater difference between the detected compartment temperature and the target temperature, or when the cooling circuit is required to operate with a greater refrigerant performance. When the level of the current is increased, the magnitude of the attractive force between the fixed core 60 and the movable core 61 is increased, which increases the resultant force urging the valve body 52 in a direction closing the valve hole 53. This lowers the target value of the suction pressure Ps. The bellows 56 controls the opening of the valve hole 53 with the valve body 52 such that the suction pressure is maintained at the lowered target value. That is, the control valve 46 adjusts the displacement of the compressor such that the suction pressure is steered to a lower value when the level of current supplied to the coil 64 is increased.

When the current supplied to the coil 64 is increased or when the suction pressure increases, the valve body 52 decreases the opening size of the valve hole 53. This decreases the flow rate of refrigerant gas supplied to the crank chamber 15 from the discharge chamber 38. Since refrigerant gas in the crank chamber 15 is constantly conducted to the suction chamber 37 through the bleeding passage 45, the crank chamber pressure Pc is gradually lowered. As result, the tilt moment increases the inclination of the swash plate 31. Accordingly, the compressor displacement is increased. When the compressor displacement is increased, the cooling performance of the cooling circuit is increased, which lowers the suction pressure.

The controller C decreases the value of the current supplied to the coil 64 when the difference between the detected compartment temperature and the target temperature becomes smaller, or when the cooling circuit is required to operate with a smaller refrigerant performance. When the current decreases, the magnitude of the attractive force between the fixed core 60 and the movable core 61 decreases, which decreases the resultant force urging the valve body 52 in a direction closing the valve hole 53. This raises the target value of the suction pressure. The bellows 56 controls the opening of the valve hole 53 with the valve body 52 such that the suction pressure is steered to the raised target value. That is, the control valve 46 adjusts the displacement of the compressor such that the suction pressure is maintained at a higher value when the level of the current supplied to the coil 64 is decreased.

When the level of the current to the coil 64 is decreased or when the suction pressure is lowered, the valve body 52 increases the opening size of the valve hole 53. This increases the flow rate of refrigerant gas supplied to the crank chamber 15 from the discharge chamber 38. If the flow rate of refrigerant gas supplied from the discharge chamber 38 to the crank chamber 15 is greater than the flow rate of refrigerant gas released from the crank chamber 15 to the suction chamber 37, the crank chamber pressure Pc gradually increases. As a result, the tilt moment decreases the inclination of the swash plate 31. The compressor displacement is decreased accordingly. When the compressor displacement decreases, the cooling performance of the cooling circuit decreases, which raises the suction pressure.

As shown in FIGS. 1 and 2, a check valve 92 is located between the suction chamber 37 and the evaporator 74. Specifically, a suction passage 90 is formed in the rear housing 13 to connect the suction chamber 37 with the external refrigerant circuit 71. The evaporator 74 is connected to the suction passage 90 through a pipe 71*a*, which is part of the circuit 71. The suction passage 90 has an attachment hole 91 that opens to the suction chamber 37. The diameter of the attachment hole 91 is greater than that of the rest the passage 90. A positioning step 91*a* is formed at the outer end of the attachment hole 91.

The check valve 92 has a hollow cylindrical casing 96. The check valve 92 is press fitted in the attachment hole 91 such that an end of the casing 96 contacts the positioning step 91*a*. The casing 96 has a valve hole 93*a* that communicates with the suction passage 90. The casing 96 also includes a valve seat 93 formed about the inner end of the valve hole 93*a*. A valve body 94 is housed in the casing 96 to face the valve seat 93. A closing spring 95 is housed in the casing 96 to urge the valve body 94 toward the valve seat 93.

Part of the casing 96 is exposed in the suction chamber 37. Openings 96*a* are formed in the exposed portion. The openings 96*a* communicate the valve hole 93*a* with the suction chamber 37 through the interior of the casing 96. A hole 96*b* is formed in the casing 96 at the opposite side of the valve body 94 from the valve hole 93*a*. The hole 96*b* connects the interior of the casing 96 with the suction chamber 37 to permit the suction pressure Ps to act on the valve body 94 as a back pressure.

Figure 3:
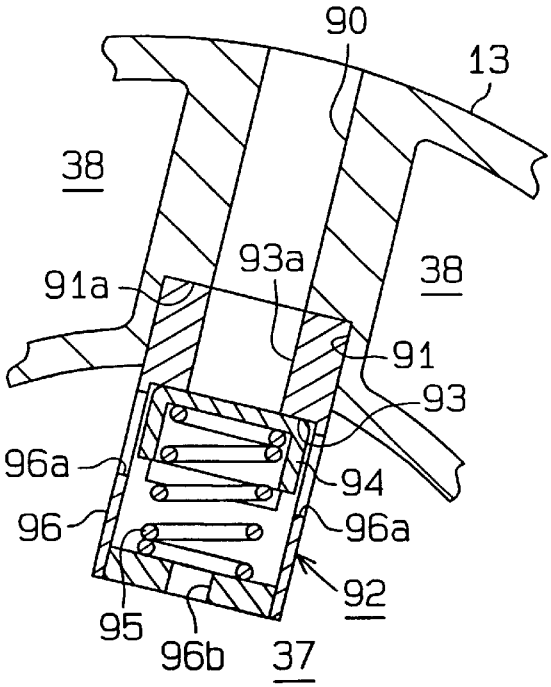
FIG. 3 is an enlarged partial cross-sectional view showing the check valve of FIG. 2 when it closes the suction passage.

The valve body 94 is exposed to the pressure at the outlet of the evaporator 74 through the valve hole 93*a* and is exposed to the pressure in the suction chamber 37 through the hole 96*b*. Based on the difference of the pressures, the valve body 94 opens or closes the valve hole 93*a*. When the pressure at the evaporator outlet is higher than the pressure in the suction chamber, the valve body 94 is separated from the valve seat 93 as shown in FIG. 2 to open the valve hole 93*a*. When the compressor is operating, refrigerant gas is drawn into the cylinder bores 33 from the suction chamber 37 and is drawn into the suction chamber 37 from the evaporator 74. Therefore, the valve body 94 opens the valve hole 93*a* to permit gas to flow from the evaporator 74 to the suction chamber 37. When the pressure at the evaporator outlet is equal to or lower than the pressure in the suction chamber 37, the valve body 94 contacts the valve seat 93 as shown in FIG. 3 to close the valve hole 93*a*. Thus, the check valve 92 permits gas to flow from the evaporator 74 to the suction chamber 37 while prohibiting gas flow from the suction chamber 37 to the evaporator 74.

The characteristic operations of the embodiment shown in FIGS. 1 to 7(*b*) will now be described.

When the air conditioner switch 80 is turned off while the compressor is operating or when the compartment temperature is lower than the target temperature, the controller C stops supplying current to the coil 29 thereby disengaging the clutch 23. The compressor is stopped accordingly. At the same time, the controller C stops supplying current to the coil 64 of the control valve 46. When the engine Eg is stopped while the compressor is operating, the power supply wire from the power source S to the coils 29, 64 is disconnected upstream of the controller C. Accordingly, the clutch 23 is disengaged and the compressor is stopped.

When the current to the coil 64 is discontinued as the compressor is stopped, the attraction force between the fixed core 60 and the movable core 61 is eliminated. Accordingly, the control valve 46 fully opens the supply passage 44 with the opening spring 54, and the inclination of the swash plate 31 is minimized. When the compressor is started again, the displacement of the compressor is minimized, which minimizes the torque. The shock caused by starting the compressor is thus reduced.

If the control valve 46 fully opens the supply passage 44 when the compressor is operating at the maximum displacement, in other words, if the control valve 46 fully opens the supply passage 44 after the supply passage 44 is fully closed, highly pressurized gas in the discharge chamber 38 is quickly supplied to the crank chamber 15. The crank chamber pressure Pc is therefore suddenly increased.

Figure 7A:
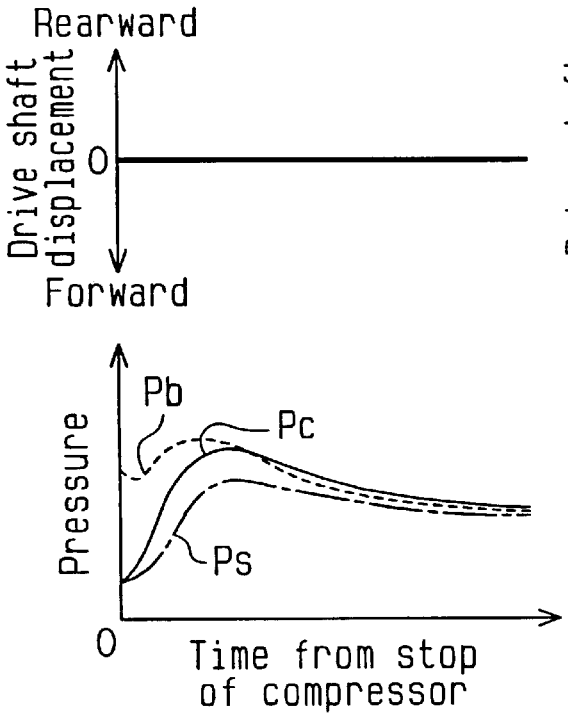
FIG. 7(*a*) shows a graph representing displacement of the drive shaft of the compressor shown in FIG. 1 and a graph representing the changes of the crank chamber pressure, the suction pressure and the cylinder bore pressure after the compressor of FIG. 1 is stopped.
Figure 7B:
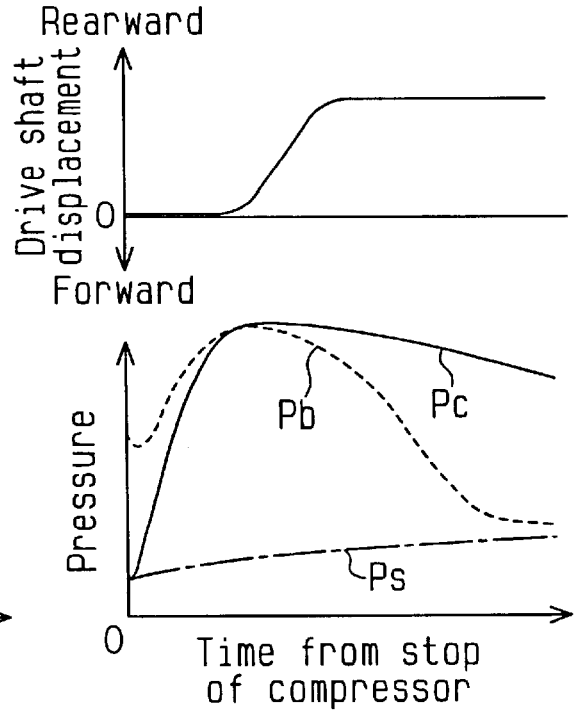

The lower graph of in FIG. 7(*a*) shows changes of the crank chamber pressure Pc, the suction pressure Pc and the bore pressure Pb over time after the compressor is stopped. As shown in the graph, when the compressor is stopped after operating at the maximum displacement, fully opening the control valve 46 suddenly increases the crank chamber pressure Pc, which is substantially equal to the suction pressure Ps before the compressor is stopped.

When the compressor is stopped, the refrigerant circulation between the compressor and the refrigerant circuit 71 is stopped. Refrigerant gas is therefore not supplied to the suction chamber 37 from the evaporator 74. Highly pressurized refrigerant gas in the crank chamber 15 flows to the suction chamber 37 through the bleeding passage 45. Therefore, the pressure Ps of the suction chamber 37 increases beyond the pressure at the outlet of the evaporator 74. The check valve 92 thus closes the suction passage 90 and prevents refrigerant gas from reversely flowing from the suction chamber 37 to the evaporator 74. In this state, the pressure Ps in the suction chamber 37 is quickly increased by refrigerant gas from the crank chamber 15. The check valve 92 functions as a pressure accelerator or an acceleration means for accelerating an increase of the pressure Ps in the suction chamber 37.

The pressure Pb in the cylinder bores 33 is never lower than the pressure Ps in the suction chamber 37. Refrigerant gas in the cylinder bores 33 leaks to the suction chamber 37 through the suction valve flap 41. However, since the pressure Ps in the suction chamber 37 is relatively high, the pressure Pb in the cylinder bores 33 is relatively high.

The bore pressure Pb in the lower graph of in FIG. 7(*a*) represents the average value of the pressures in the cylinder bores 33. As shown in the graph, the bore pressure Pb increases after the compressor is stopped. This is because some of the pistons 35 move toward the valve plate assembly 14 as the inclination of the swash plate 31 decreases and the refrigerant gas in the cylinder bores 33 is compressed.

In this manner, although the crank chamber pressure Pc is increased when the compressor is stopped, the bore pressure Pb is relatively high. The crank chamber pressure Pc acts to decreases the inclination of the swash plate 31 while the bore pressure Pb acts to increase the inclination of the swash plate 31. Therefore, even if the control valve 46 suddenly and fully opens the supply passage 44, the tilt moment that decreases the swash plate inclination does not become excessive.

The suction pressure zone ranges from the outlet of the evaporator 74 to the suction chamber 37. The pressure sensing chamber 55 of the displacement control valve 46 is connected to the suction chamber 37, which is located downstream of the check valve 92. Thus, if the pressure in the suction chamber 37 increases when the check valve 92 is closed, the pressure in the pressure sensing chamber 55 also increases. As the pressure in the pressure sensing chamber 55 is increased, the bellows 56 contracts and moves the valve body 52 to decrease the opening size of the valve hole 53. This decreases the flow rate of refrigerant gas supplied from the discharge chamber 38 to the crank chamber 15. Accordingly, a sudden increase of the crank chamber pressure Pc is eased in progress. In other words, the increase of the crank chamber pressure Pc is limited after a predetermined time period has elapsed from when the compressor is stopped. This effectively reduces the force that urges the pistons 35 rearward.

As a result, when moving from the maximum inclination position to the minimum inclination position, the swash plate 31 neither strongly presses the limit ring 34 nor strongly pulls the hinge mechanism 32 and the rotor 30. Therefore, the drive shaft 16 is not moved rearward against the force of the support spring 20 (see the upper graph of in FIG. 7(*a*)).

Since the drive shaft 16 is prevented from being axially displaced, the drawbacks described in the Background section, that is, displacement of the drive shaft 16 relative to the lip seal 22, contact between the armature 28 and the pulley 24 when the clutch 23 is disengaged, and collision of the pistons 35 against the valve plate assembly 14, are all resolved.

The graphs of FIG. 7(*b*) show the characteristics of a compressor of a comparison example. The compressor is the same as the compressor of FIG. 1 except that the comparison example compressor does not have the check valve 92. When the compressor of the example is stopped, gas flow from the suction chamber 37 to the evaporator 74 is permitted even if gas is supplied from the crank chamber 15 to the suction chamber 37. The pressure Ps in the suction chamber 37 is therefore increased only slightly. The pressure Pb in the cylinder bores 33 is lowered to the lower pressure Ps of the suction chamber 37. Since the pressure Ps in the suction chamber 37 is not significantly increased, the bellows 56 does not contract and the valve body 52 remains at a position fully opening the valve hole 53. Thus, the crank chamber pressure Pc continues to increase. As a result, the force that urges the pistons 35 rearward becomes excessive, which moves the drive shaft 16 rearward.

The compressor FIG. 1 has the control valve 46, which controls the flow rate of highly pressurized gas supplied to the crank chamber 15. Compared to a compressor that controls the amount of refrigerant gas released from the crank chamber 15, the compressor of FIG. 1 quickly changes the pressure in the crank chamber 15, which permits the inclination of the swash plate 31, that is, the compressor displacement, to be quickly changed. However, from a different viewpoint, compared to a compressor that controls the amount of refrigerant gas discharged from the crank chamber 15, the compressor of FIG. 1 tends to increase the pressure in the crank chamber 15 to an excessive level. Thus, it is advantageous to provide the check valve 92 in the compressor having the control valve 46, which controls the amount of highly pressurized gas supplied to the crank chamber 15.

The check valve 92 may be located in the pipe 71*a* between the evaporator 74 and the suction passage 90 without departing from the concept of the present invention. However, this requires a change of the structure of the conventional pipe 71*a*. Since the check valve 92 is located in the compressor rear housing 13, a conventional pipe 71*a* is used without changing its structure.

The check valve 92 stops the flow of refrigerant at a position near the suction chamber 37. If the check valve 92 is located at the outlet of the evaporator 74, which is away from the suction chamber 37, refrigerant gas from the crank chamber 15 will increase the pressure in a relatively large space that includes suction chamber 37 and the pipe 91*a*. In the embodiment of FIGS. 1 to 7(*a*), refrigerant gas from the crank chamber 15 increases the pressure in a relatively small space that only includes the suction chamber 37, which permits the pressure in the suction chamber 37 to be quickly increased. As a result, the force that decreases the inclination of the swash plate 31 is limited.

The check valve 92 is a unit, which has all the members in the casing 96. Therefore, the check valve 92 is previously formed as a unit and is then press fitted into the hole 91 of the rear housing 13. The check valve 92 is thus easily installed in the compressor.

The structure of the control valve 46 may be changed such that the attractive force generated between the fixed core 60 and the movable core 61 moves the valve body 52 in a direction increasing the opening size of the valve hole 53. Such a change to the control valve 46 does not deviate from the concept of the present invention. If this change is made, the power supply wire between the coil 64 and the power source S must be also modified. Specifically, the power supply wire must not be disconnected upstream of the controller C. Such a modification to the power supply wire requires a major change to the electric system of a conventional vehicle.

However, in the control valve 46, the attractive force between the fixed core 60 and the movable core 61 urges the valve body 52 in a direction decreasing the opening size of the valve hole 53. Thus, when the engine Eg is stopped, disconnecting the power supply wire between the coil 64 and the power source S upstream of the controller C causes the valve hole 53 to open, which minimizes the compressor displacement. In other words, the compressor displacement is minimized when the engine Eg is stopped without changing the electric system of a conventional vehicle.

Figure 8:
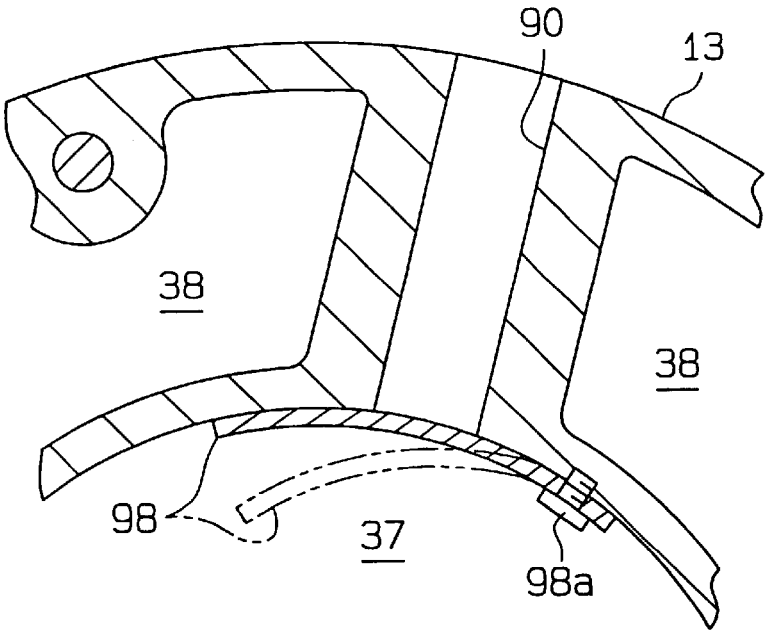
FIG. 8 is an enlarged partial cross-sectional view illustrating a check valve according to a second embodiment of the present invention.

FIG. 8 illustrates a second embodiment of the present invention. In this embodiment, a flap valve (reed valve) 98 is used. One end of the flap valve 98 is fixed to the wall of the suction chamber 37 by a bolt 98*a*. The flap valve 98 opens and closes the outlet of the suction passage 90 in accordance with the pressure difference between the suction chamber 37 and the evaporator 74. The flap valve 98, which is a check valve, is smaller and simpler than the check valve 92 of FIG. 2.

A third embodiment of the present invention will now be described with reference to FIGS. 9 to 11. The third embodiment relates to an improvement of the control valve 46. The differences from the embodiment of FIGS. 1 to 7(*a*) will mainly be discussed below, and like or the same reference numerals are given to those components that are like or the same as the corresponding components of the embodiment of FIGS. 1 to 7(*a*).

Figure 9:
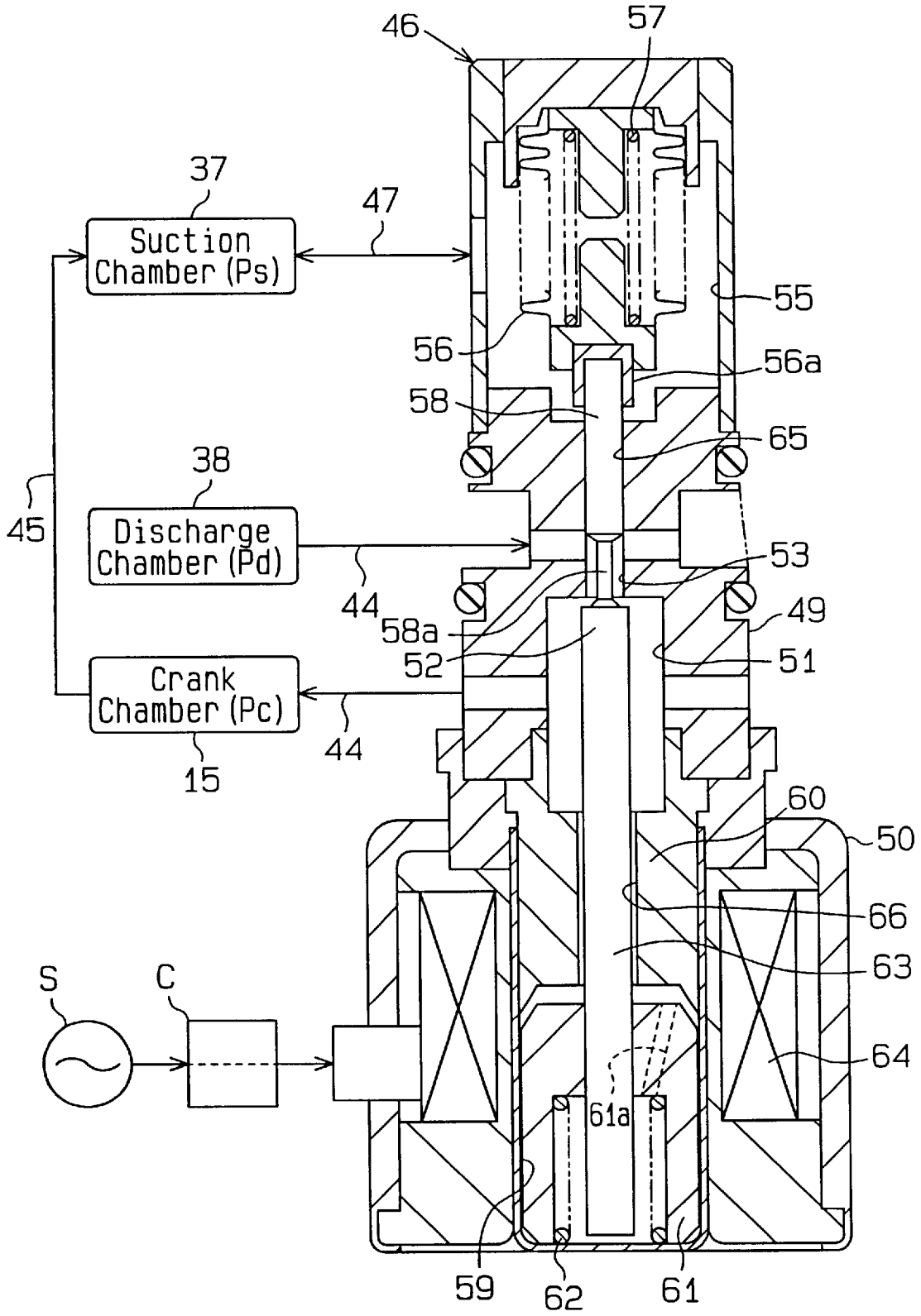
FIG. 9 is a cross-sectional view illustrating a displacement control valve according to a third embodiment of the present invention.

As shown in FIG. 9, the diameters of the valve body 52 and the solenoid rod 63 are the same such that the valve body 52 and the solenoid rod 63 form a single shaft. Unlike the control valve 46 of FIG. 4, the control valve 46 of FIG. 9 does not have the opening spring 54 in the valve chamber 51. Also, unlike the control valve 46 of FIG. 4, the valve chamber 51 is connected to the crank chamber 15 through the downstream portion of the supply passage 44, and the valve hole 53 is connected to the discharge chamber 38 through the upstream portion of the supply passage 44.

The distal end of the pressure sensing rod 58 is loosely fitted in but is not fixed to the coupler cylinder 56*a* of the bellows 56. The cross-sectional area S2 of the rod 58, except for the small diameter portion 58*a*, is equal to the cross-sectional area of the valve hole 53.

The solenoid rod 63 extends through and is fixed to the movable core 61. A space is defined between the surface of the solenoid rod 63 and the surface of the guide hole 66 to connect the valve chamber 51 with the plunger chamber 59. A through hole 61*a* is formed in the movable core 61. The through hole 61*a* connects two spaces in the plunger chamber 59 that are separated by the movable core 61. Thus, like the valve chamber 51, the entire plunger chamber 59 is exposed to the crank chamber pressure Pc.

Figure 10A:
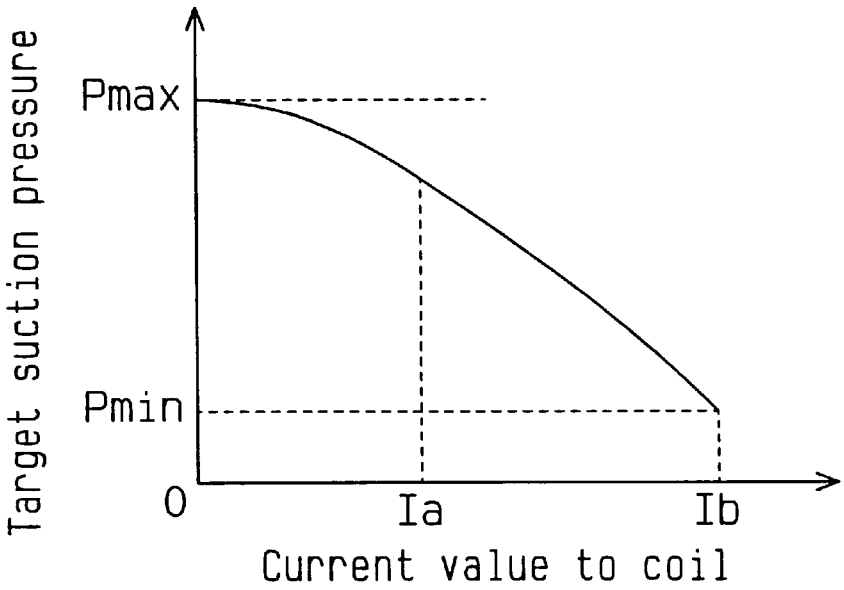
FIG. 10(*a*) is a graph showing the value of current supplied to the control valve of FIG. 9 and a target suction pressure.
Figure 10B:
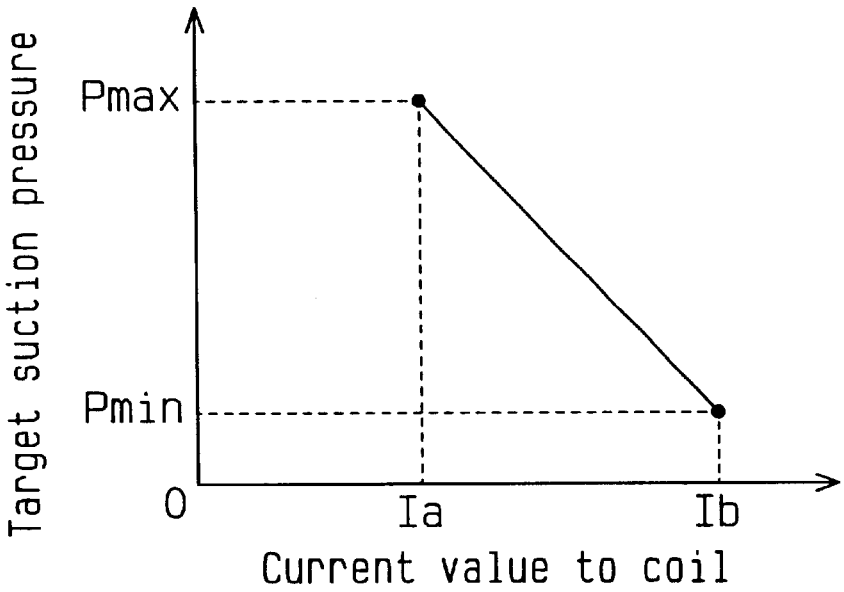
Figure 11:
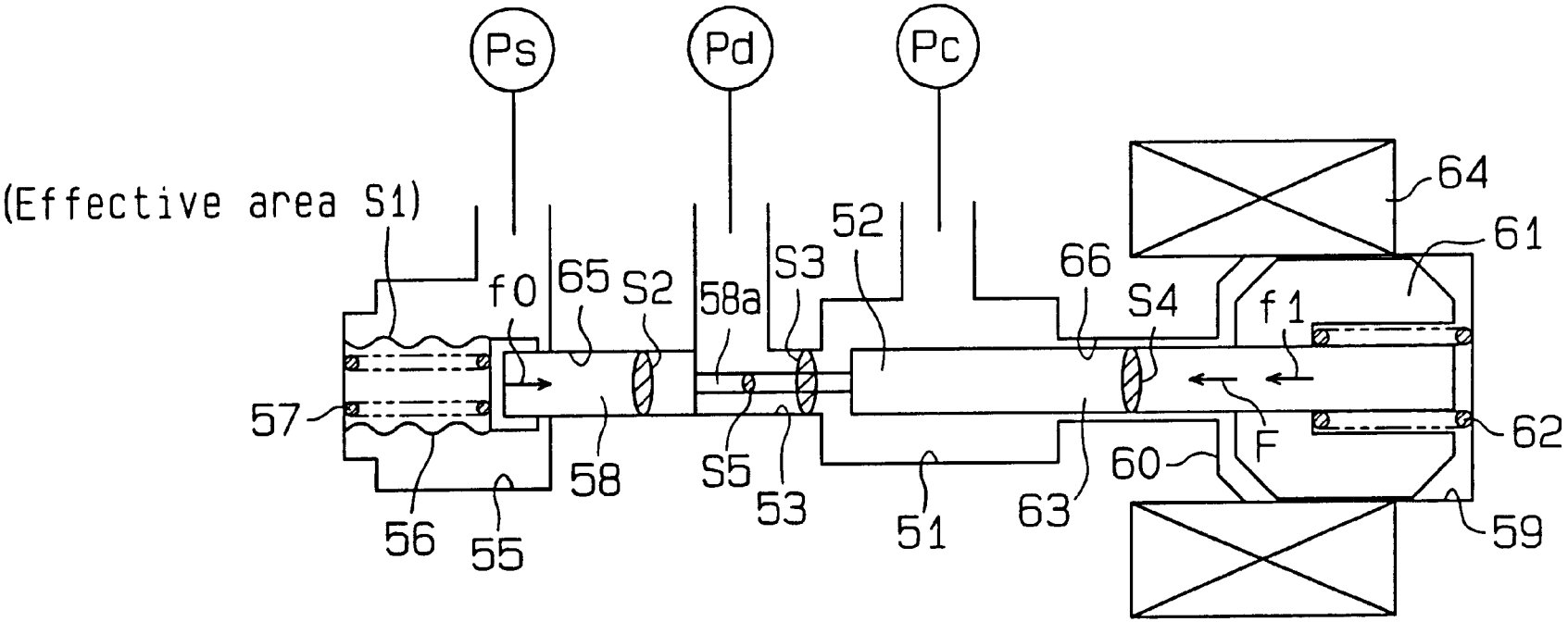
FIG. 11 is a diagrammatic view showing forces applied to the parts of the control valve shown in FIG. 9.
Figure 12:
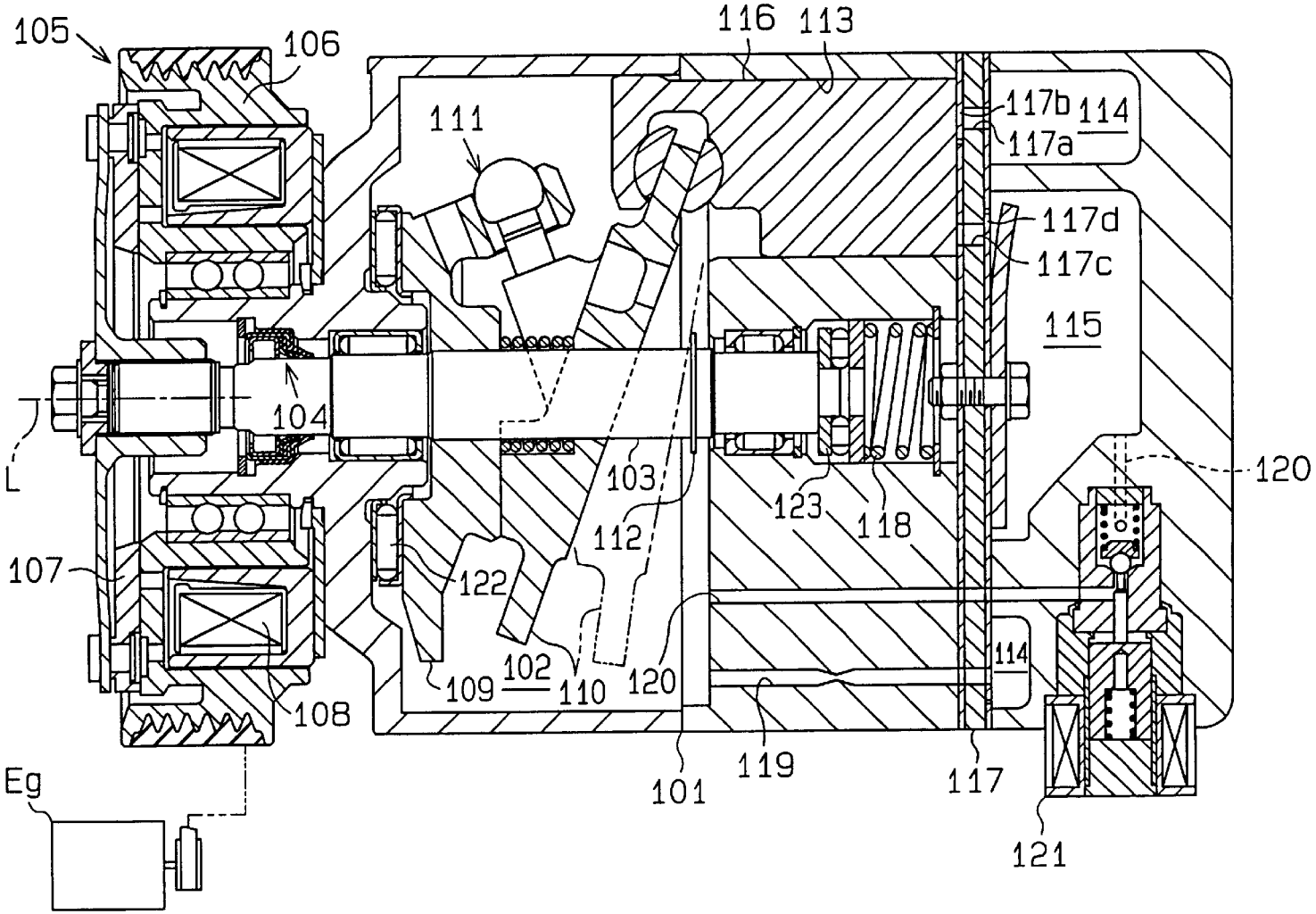
Fig.12(Prior Art)
FIG. 12 is a cross-sectional view illustrating a prior art variable displacement compressor.

FIG. 10(*a*) is a graph showing the characteristics of the control valve 46 shown in FIG. 9. The attraction force between the fixed core 60 and the movable core 61 is decreased when the level of the current to the coil 64 of the control valve 46 is decreased. Thus, the target suction pressure increases when the input current decreases. If there is little difference between the compartment temperature and the target temperature during operation of the compressor, the current supply to the coil 64 is stopped and the target suction pressure is set to a maximum value Pmax. In this state, the follower spring 62 urges the movable core 61 toward the bellows 56. Therefore, the pressure sensing rod 58 is constantly pressed against the bellows 56. The distal end of the pressure sensing rod 58 is moved integrally with the coupler cylinder 56*a*. Therefore, the bellows 56 moves the valve body 52 in accordance with the pressure in the pressure sensing chamber 55 such that the suction pressure Ps seeks the target suction pressure, which is the maximum value Pmax.

In this manner, the control valve 46 of FIG. 9 operates in accordance with the pressure in the pressure sensing chamber 55 for any value of current supplied to the coil 64. In other words, the control valve 46 of FIG. 9 causes the suction pressure Ps to seek a target value for any value of the current supplied to the coil 64. This means that the target suction pressure is determined for the entire range of the value of the current supplied to the coil 64. Even if the current to the coil 64 is stopped, the target suction pressure is determined.

When the compressor is stopped, current to the coil 64 is also stopped. Since the compressor is not operating, the suction pressure Ps does not seek the maximum value Pmax. However, the control valve 46 operates in the same manner as when the target suction pressure is the maximum value Pmax. That is, as in the embodiment of FIGS. 1 to 7(*a*), if the pressure in the suction chamber 37 is increased beyond the maximum value Pmax due to closure of the check valve 92 after the compressor is stopped, the bellows 56 contracts and causes the valve body 52 to move in the direction that decreases the opening size of the valve hole 53. Thus, the flow rate of refrigerant gas from the discharge chamber 38 to the crank chamber 15 is decreased, which limits a sudden increase of the crank chamber pressure Pc when the compressor is stopped. As a result, the force that urges the pistons 35 rearward is effectively reduced.

The control valve 46 of FIG. 4 has substantially the same characteristics as shown in the graphs of FIG. 10(*a*) and thus operates in substantially the same manner as the control valve 46 of FIG. 9. However, since the control valve 46 of FIG. 4 has the opening spring 54, the force of which is stronger than the force of the follower spring 62, the valve body 52 is urged away from the bellows 56 by the opening spring 54 when current to the coil 64 is stopped. Therefore, the distal end of the pressure sensing rod 58 must be fixed to the coupler cylinder 56*a* of the bellows 56 to constantly transmit the movement of the bellows 56 to the valve body 52. The upper end of the bellows 56 also must be fixed to the upper wall of the pressure sensing chamber 55. This structure complicates the assembly of the control valve 46.

In the control valve 46 of FIG. 9, the follower spring 62 continues to press the pressure sensing rod 58 against the bellows 56 and the upper end of the bellows 56 against the upper wall of the pressure sensing chamber 55 even if current is not supplied to the coil 64. Thus, the distal end of the pressure sensing rod 58 need not be fixed to the coupler cylinder 56*a* of the bellows 56. Also, the upper end of the bellows 56 need not be fixed to the upper wall of the pressure sensing chamber 55, which facilitates the assembly of the control valve 46.

As shown in FIG. 10(*a*), the target suction pressure is the minimum value Pmin when the level of current supplied to the coil 64 is a predetermined maximum value Ib. The minimum target suction value Pmin in the control valve 46 shown in FIG. 9 is determined based on the sum of the force of the follower spring 62 and the attraction force between the cores 60, 61 when the current value is the maximum value Ib. In the control valve 46 of FIG. 4, the minimum target suction value Pmin is determined based on a value calculated by subtracting force of the opening spring 54 from the sum of the force of the follower spring 62 and the attraction force between the cores 60, 61 when the current value is the maximum value Ib. Thus, the control valve 46 of FIG. 9 requires a weaker attraction force between the cores 60, 61 to obtain the minimum value Pmin of the target suction pressure compared to the control valve 46 of FIG. 4. Accordingly, the control valve 46 of FIG. 9 needs a smaller coil 64 compared to the control valve 46 of FIG. 4, which reduces the consumption of electricity.

The graph of FIG. 10(*b*) shows the characteristics of a control valve of a comparison example. The comparison example control valve is the same as the control valve of FIG. 4 except that the distal end of the pressure sensing rod 58 is loosely fitted in but not fixed to the coupler cylinder 56*a* of the bellows 56. In the example control valve, when the value of current supplied to the coil 64 is decreased below a predetermined value Ia, the opening spring 54 moves the valve body 52 to the fully open position against the sum of the force of the follower spring 62 and the attraction force between the cores 60, 61. Therefore, the movement of the bellows 56, which corresponds to the pressure in the pressure sensing chamber 55, is not transmitted to the valve body 52. This means that if the current value is lower than the predetermined value Ia, the suction pressure cannot be controlled, that is, the target suction pressure cannot be determined. Thus, as described above, the example control valve cannot reduce the force that urges the pistons 35 rearward after the compressor is stopped.

Also, as shown in the graph of FIG. 10(*b*), the target suction value cannot be set if the current value is lower than the value Ia. Therefore, the maximum value Pmax of the target suction pressure must be determined in accordance with the current value Ia. The target suction pressure is thus varied between a narrow range that corresponds to the range between the upper limit value Ib and the value Ia of the current. The ratio of the change of the target suction pressure to a change of the input current value must be set relatively great. The target pressure value thus cannot be finely adjusted.

Contrary to the example control valve, the control valve 46 of FIG. 9 changes the target suction pressure in a wide range between zero and the upper limit value Ib of the input current value. The ratio of a change of the target suction pressure to the change of the input current value can be set relatively small, which permits the target suction pressure to be finely controlled. The target suction pressure can be finely adjusted in accordance with subtle changes of required refrigerant performance of the cooling circuit. This advantage is also obtained by the control valve 46 of FIG. 4.

The equilibrium of forces acting on the valve body 52 in the control valve 46 of FIG. 9 is expressed by the following equation.

$$f0-S1\cdot Ps+S2\cdot Ps-(S2-S5)Pd=S4\cdot Pc-(S3-S5)Pd+f1+F \quad (1)$$

in which:

S1 is the effective pressure receiving area of the bellows 56;

S2 is the cross-sectional area of the pressure sensing rod 58;

S3 is the cross-sectional area of the valve hole 53;

S4 is the cross-sectional area of the solenoid rod 63;

S5 is the cross-sectional area of the small diameter portion 58*a;*

F is the electromagnetic force between the cores 60, 61;

f0 is the force of the setting spring 57;

f1 is the force of the follower spring 62;

Ps is the suction pressure (the pressure in the pressure sensing chamber 55);

Pc is the crank chamber pressure (the pressure in the valve chamber 51 and the plunger chamber 59); and Pd is the discharge pressure (the pressure in the valve hole 53).

The cross-sectional area S2 of the pressure sensing rod 58 is equal to the cross-sectional area S3 of the valve hole 53. Therefore, if the cross-sectional area S3 is replaced by the cross-sectional area S3, the following equation (2) is obtained.

$$f0-S1\cdot Ps+S2\cdot Ps-(S2-S5)Pd=S4\cdot Pc-(S2-S5)Pd+f1+Ff0-S1\cdot Ps+S2\cdot Ps=S4\cdot Pc+f1+FPs=(f0-S4\cdot Pc-f1-F)/(S1-S2) \quad (2)$$

As shown in the equation (2), the valve body 52 is not directly influenced by the discharge pressure Pd. Since the discharge pressure Pd is relatively high, the influence on the valve body 52 would be significant. However, the control valve 46 of FIG. 9 prevents the valve body 52 from being influenced by the high discharge pressure Pd, which permits the opening size of the valve hole 53 to be accurately and readily controlled.

The pressure sensing rod 58 is supported by the guide hole 65. In other words, one end of the unit, which includes the pressure sensing rod 58, the valve body 52, the solenoid rod 63 and the movable core 61, is supported by the inner wall of the guide hole 65. The movable core 61, which is the other end of the unit, is supported by the inner wall of the plunger chamber 59. This structure stabilizes the axial movement of the unit.

It should be apparent to those skilled in the art that the present invention may be embodied in many other specific forms without departing from the spirit or scope of the invention. More particularly, the present invention may be modified as described below.

In the embodiments of FIGS. 1 to 11, the pressure sensing mechanism, which includes the bellows 56, may be omitted from the displacement control valve 46. In this case, the objective of the present invention will be achieved by the check valves 92, 98.

Instead of or in addition to the displacement control valve 46 located in the supply passage 44, a displacement control valve may be located in the bleeding passage 45, which connects the crank chamber 15 to the suction chamber 37. In this case, the bleeding passage 45 must not be fully closed.

In the control valve 46 of FIG. 9, the pressure sensing rod 58 and the valve body 52 may be separately formed and the rod 58 and the valve 52 may be connected to each other such that they slide axially with respect to each other. In this case, the control valve 46 operates in the same way as the control valve of FIG. 9 and has the same advantages.

Instead of the bellows 56, a diaphragm may be used as the pressure sensing member.

The present invention may be embodied in compressors other than the compressor of FIG. 1. For example, the present invention may be embodied in a wobble plate type compressor. In a wobble plate type compressor, a rod extending from each piston is coupled to a wobble plate. When a drive shaft rotates, the wobble plate wobbles without being rotated.

The present examples and embodiments are to be considered as illustrative and not restrictive and the invention is not to be limited to the details given herein, but may be modified within the scope and equivalence of the appended claims.

What is claimed is:

1. A compressor for compressing gas supplied from an evaporator of an external refrigerant circuit and for discharging the compressed gas to the external refrigerant circuit, the compressor comprising:

a housing;

a cylinder bore defined in the housing;

a crank chamber defined in the housing;

a suction chamber defined in the housing, the suction chamber being connected to the outlet of the evaporator, wherein gas is constantly released from the crank chamber to the suction chamber;

a piston accommodated in the cylinder bore, wherein the piston compresses gas drawn into the cylinder bore from the suction chamber and discharges the compressed gas from the cylinder bore;

a drive shaft supported by the housing;

a drive plate coupled to the piston to convert rotation of the drive shaft into reciprocation of the piston, wherein the drive plate is supported by the drive shaft to incline relative to the drive shaft and is moved between a maximum inclination position and a minimum inclination position in response to a tilt moment acting on the drive plate, wherein the tilt moment has components including a moment based on the pressure in the crank chamber and a moment based on the pressure in the cylinder bore, and wherein the inclination of the drive plate defines the stroke of the piston and the displacement of the compressor;

a control valve, wherein the control valve controls the pressure in the crank chamber to change the inclination of the drive plate, and wherein the control valve is actuated based on an external command; and a check valve located between the suction chamber and the evaporator, wherein the check valve is closed based on the pressure difference between the suction chamber and the outlet of the evaporator to prevent gas from flowing from the suction chamber to the evaporator.

2. The compressor according to claim 1, wherein the check valve is located in the housing.

3. The compressor according to claim 1, wherein the check valve is a single unit having a plurality of preassembled.

4. The compressor according to claim 1, wherein the check valve is a flap valve.

5. The compressor according to claim 1, wherein the pressure in the crank chamber acts on the drive plate to decrease the inclination of the drive plate, and wherein, when the compressor is stopped, the control valve increases the pressure in the crank chamber to move the drive plate to the minimum inclination position.

6. The compressor according to claim 5, wherein, when the compressor is not operating, the control valve prevents the pressure in the crank chamber from increasing in response to an increase of the pressure in the suction chamber.

7. The compressor according to claim 5, further comprising:

a discharge chamber defined in the housing to receive gas discharged from the cylinder bore; and a supply passage connecting the crank chamber with the discharge chamber, wherein the control valve is located in the supply passage to regulate the amount of gas supplied from the discharge chamber to the crank chamber.

8. The compressor according to claim 1, wherein the control valve includes:

a valve body;

a pressure sensing member, wherein the pressure sensing member moves the valve body in response to the pressure in the suction chamber; and an actuator for actuating the valve body in response to an external command.

9. The compressor according to claim 8, wherein the pressure sensing member moves the valve body such that the pressure in the suction chamber is maintained at a predetermined target value, and wherein the actuator applies a force to the valve body, wherein the force corresponds to the level of a current supplied to the actuator, and the level of the current determines a target value of the pressure in the suction chamber.

10. The compressor according to claim 9, wherein the actuator increases the target value as the level of the current is decreased and sets the target value to a maximum value when no current is supplied to the actuator.

11. The compressor according to claim 9, wherein the level of the current supplied to the actuator is varied in a range between zero to a predetermined maximum value, and wherein the pressure sensing member moves the valve body in response to the pressure in the suction chamber throughout the range of the current.

12. The compressor according to claim 1, wherein the drive shaft is coupled to an external drive source, and wherein a clutch is located between the external drive source and the drive shaft to selectively transmit the power of the drive source to the drive shaft.

13. A compressor for compressing gas supplied from an evaporator of an external refrigerant circuit and for discharging the compressed gas to the external refrigerant circuit, the compressor comprising:

a housing;

a cylinder bore defined in the housing;

a crank chamber defined in the housing;

a suction chamber defined in the housing, the suction chamber being connected to the outlet of the evaporator, wherein gas is constantly released from the crank chamber to the suction chamber;

a piston accommodated in the cylinder bore, wherein the piston compresses gas drawn into the cylinder bore from the suction chamber and discharges the compressed gas from the cylinder bore;

a drive shaft supported by the housing;

a drive plate coupled to the piston to convert rotation of the drive shaft into reciprocation of the piston, wherein the drive plate is supported by the drive shaft to incline relative to the drive shaft and is moved between a maximum inclination position and a minimum inclination position in response to a tilt moment acting on the drive plate, wherein the tilt moment has components including a moment based on the pressure in the crank chamber and a moment based on the pressure in the cylinder bore, and wherein the inclination of the drive plate defines the stroke of the piston and the displacement of the compressor;

a control valve, wherein the control valve controls the pressure in the crank chamber to change the inclination of the drive plate, wherein the control valve is actuated based on an external command, wherein, when the compressor is stopped, the control valve increases the pressure in the crank chamber to move the drive plate to the minimum inclination position; and a pressure accelerator for accelerating an increase of the pressure in the suction chamber after the compressor is stopped.

14. The compressor according to claim 13, wherein, when the compressor is not operating, the control valve prevents the pressure in the crank chamber from increasing in response to an increase of the pressure in the suction chamber.

15. A displacement control valve for adjusting the pressure in a crank chamber of a compressor to change the displacement of the compressor, wherein the compressor includes a suction pressure zone, the pressure of which is a suction pressure, a discharge pressure zone, the pressure of which is a discharge pressure, and a supply passage connecting the crank chamber to the discharge pressure zone, the control valve comprising:

a valve body to adjust the size of an opening in the supply passage;

a pressure sensing member, wherein the pressure sensing member moves the valve body in response to the suction pressure to maintain the suction pressure at a predetermined target value; and an electromagnetic actuator for applying a force to the valve body, wherein the force corresponds to the level of a current supplied to the actuator, and the level of the current determines a target value of the suction pressure, and wherein the actuator increases the target value as the level of the current decreases and sets the target value to a maximum value when no current is supplied to the actuator.

16. The compressor according to claim 15, wherein the level of the current supplied to the electromagnetic actuator is varied in a range between zero to a predetermined maximum value, and wherein the pressure sensing member moves the valve body in response to the suction pressure throughout the range of the current.

17. The control valve according to claim 15, wherein the pressure sensing member is arranged at an opposite side of the valve body with respect to the electromagnetic actuator, the control valve further comprising:

a transmitter for transmitting movement of the pressure sensing member to the valve body, wherein the transmitter couples the valve body to the pressure sensing member such that the valve body can be moved away from the pressure sensing member; and a spring for urging the valve body toward the pressure sensing member, wherein, when no current is supplied to the actuator, the spring causes the valve body and a movable part of the pressure sensing member to move in unison.

18. A method for controlling the displacement of a variable displacement compressor, wherein the compressor includes a drive plate that is moved between a maximum inclination position and a minimum inclination position in accordance with the pressure in a crank chamber, the inclination of the drive plate defining the displacement of the compressor, the method including:

controlling the pressure in the crank chamber to change the inclination of the drive plate when the compressor is operating;

increasing the pressure in the crank chamber to move the drive plate to the minimum inclination position when the compressor is stopped; and restricting an increase of the pressure in the crank chamber when a predetermined time has elapsed after the compressor is stopped.

19. The method according to claim 18, further including isolating a suction chamber in the compressor from an external refrigerant circuit to increase the pressure in the suction chamber using gas from the crank chamber when the compressor is stopped, wherein the step of increasing the pressure in the crank chamber is executed in response to an increase of the pressure in the suction chamber.

20. The compressor according to claim 1 further comprising a support spring for urging the drive shaft along an axis of the drive shaft.

* * * * *

UNITED STATES PATENT AND TRADEMARK OFFICE

CERTIFICATE OF CORRECTION

PATENT NO. : 6,352,416 B1
DATED : March 5, 2002
INVENTOR(S) : Ota et al.

It is certified that error appears in the above-identified patent and that said Letters Patent is hereby corrected as shown below:

Column 7,
Lines 27-28, please delete "gas 7.from" and insert therefor -- gas from --.

Signed and Sealed this

Fourth Day of June, 2002

*Attest:*

*Attesting Officer*

JAMES E. ROGAN
*Director of the United States Patent and Trademark Office*